US006637218B2

(12) United States Patent
Kasahara

(10) Patent No.: US 6,637,218 B2
(45) Date of Patent: Oct. 28, 2003

(54) GAS HEAT PUMP-TYPE AIR CONDITIONER

(75) Inventor: Hideaki Kasahara, Nishi-kasugai-gun (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 169 days.

(21) Appl. No.: 09/986,559

(22) Filed: Nov. 9, 2001

(65) Prior Publication Data

US 2002/0095941 A1 Jul. 25, 2002

(30) Foreign Application Priority Data

Jan. 19, 2001 (JP) ..... 2001-011036

(51) Int. Cl.[7] ..... F25B 27/00; F01M 11/10

(52) U.S. Cl. ..... 62/126; 62/129; 62/193; 62/228.4; 62/323.1; 123/196 S; 340/457.4; 368/5

(58) Field of Search ..... 62/125, 126, 127, 62/129, 130, 192, 193, 323.1, 323.4, 228.1, 228.4; 368/5; 73/53.05; 340/450.3, 457.4; 701/30; 123/196 S

(56) References Cited

U.S. PATENT DOCUMENTS

| | | | | |
|---|---|---|---|---|
| 4,677,847 A | | 7/1987 | Sawatari et al. | 73/64 |
| 4,970,492 A | | 11/1990 | King | 340/450.3 |
| 5,060,156 A | | 10/1991 | Vajgart et al. | 364/424.03 |
| 5,322,033 A | | 6/1994 | Doan | 116/308 |
| 5,530,647 A | | 6/1996 | Sem et al. | 364/424.03 |
| 5,765,994 A | * | 6/1998 | Barbier | 62/129 X |
| 6,037,864 A | | 3/2000 | Sem et al. | 340/457.4 |
| 6,161,395 A | * | 12/2000 | Okoren et al. | 62/193 |

FOREIGN PATENT DOCUMENTS

| | | |
|---|---|---|
| JP | 3066123 | 5/2000 |
| WO | WO 95/24677 | 9/1995 |
| WO | WO 98/29642 | 7/1998 |

* cited by examiner

*Primary Examiner*—Harry B. Tanner
(74) *Attorney, Agent, or Firm*—Oblon, Spivak, McClelland, Maier & Neustadt, P.C.

(57) ABSTRACT

The present invention provides a gas heat pump-type air conditioner that can reliably notify a user that the time for changing the engine oil of the gas engine that drives the compressor has arrived without stopping the operation of the gas engine. In a gas heat pump-type air conditioner that forms a cooling cycle by circulating refrigerant using a compressor having a gas engine as a drive source, when the cumulative hours of operation t of the gas engine reaches a second predetermined time T2 (S3), a warning display A is displayed while the operation of the gas engine continues, and thereby the user is notified that the time for changing the engine oil has arrived (S4), and at the same time, after the initial stop procedure is carried out subsequent to reaching the predetermined time T2 (S5), a warning display B is displayed (S6), and the warning restoration operation procedure (S7) is carried out.

7 Claims, 4 Drawing Sheets

GAS HEAT PUMP-TYPE AIR CONDITIONER

BACKGROUND OF THE INVENTION

1. Field of the Invention

The present invention relates to a gas heat pump-type air conditioner in which a compressor is driven using a gas engine as a drive source, and in particular, a gas heat pump-type air conditioner that can reliably notify the user about the time for changing the engine oil.

2. Description of the Related Art

An air conditioner that carries out cooling and heating by using a heat pump comprises a cooling circuit that includes elements such as an interior heat exchanger, a compressor, an exterior heat exchanger, and an expansion valve. The interior cooling and heating is realized by carrying out the respective exchange of air and heat in an interior heat exchanger and an exterior heat exchanger while the refrigerant is circulating through this circuit. In addition, in this cooling circuit, a refrigerant heater is provided for directly heating the refrigerant itself so as not to depend only on the heat of the refrigerant being absorbed (during operation as a heater) by the exterior heat exchanger.

However, in recent years, instead of the electric motor that is normally used as the drive source of the compressor in the cooling circuit described above, compressors that use gasoline engines as a drive source are being developed. Air conditioners that use this gas engine are generally called gas heat pump-type air conditioners (hereinbelow, abbreviated "GHP"). Like the air conditioner provided with a compressor that uses an electrical motor (hereinbelow, abbreviated "EHP"), with the GHP relatively inexpensive gas is used as the fuel and the running cost does not become expensive, and thus they make possible cost reductions for the users.

In addition, in a GHP, during the heating operation, for example, if the exhaust heat of the high temperature exhaust gas discharged from the gas engine is used as the heat source for the refrigerant, it is possible to obtain a superior heating effect, and at the same time, the efficiency of the energy use can be increased. Incidentally, the heating capacity in a low atmospheric temperature becomes 1.2 to 1.5 times higher than the EHP. In addition, if this type of apparatus is introduced, mechanisms such as the refrigerant heater described above need not be specially provided in the refrigerant circuit.

In addition, in a GHP, the frost removal operation, that is, the defrosting operation, of the interior heat exchanger that is necessary during heating operation can also be implemented by using the waste heat of the engine. Generally, the defrosting operation in the EHP is performed by carrying out frost elimination from the exterior heat exchanger by stopping the heating operation and temporarily carrying out a cooling operation. In this case, the pleasantness of the interior environment deteriorates because cool air is blown into the interior, and this is not desirable in terms of the air conditioning sensation. In a GHP, a continuous heating operation is possible by using the wasted heat due to the circumstances described above, and the problems that cause concern in an EHP do not occur.

However, although GHP has these many advantages, the following problems can be pointed out about the conventional GHP.

As described above, in a GHP engine oil that lubricates the gas engine is used because a gas engine serves as the drive source for the compressor. Since this engine oil will deteriorate while the gas engine is operated, at an appropriate time (that is, before the deterioration begins) maintenance in which an oil change is carried out is necessary. However, the cumulative hours of operation of the gas engine at which the change of the engine oil becomes necessary is rather long, for example, about 10,000 hours, and thus correctly judging the appropriate time for the oil change is difficult.

Against this background, a control method is proposed in Japanese Patent No. 3066123, wherein, when the cumulative hours of operation of the engine reaches a predetermined number of hours, the engine automatically stops, and at the same time, a selection choice is provided that allows extended operation of the engine for a predetermined amount of time even if an oil change is not carried out. Alternatively, when the cumulative hours of operation of the engine has reached a predetermined number of hours, an oil change warning light is displayed, and after the warning signal display for the oil change is displayed, the engine automatically stops at a predetermined operating time if an oil change is not carried out, and at the same time a selection choice is provided that allows extended operation of the engine for a predetermined time.

However, this conventional technology always stops the operation of the engine once at a predetermined amount of cumulative hours of operation of the engine or after the passage of a predetermined extended operation time without an oil change. Thereby, either the oil change is completed before the predetermined amount of the cumulative hours of operation has been reached, or the operation of the compressor that circulates the refrigerant becomes impossible when the oil change is not completed quickly after the oil change warning signal is displayed, and thus there are cases wherein the forcible stopping of the air conditioning operation becomes unavoidable when the time for the oil change has arrived.

This type of forcible stopping of the air conditioning operation is undesirable in terms of the capacity of a gas heat pump-type air conditioner to maintain a pleasant interior environment by the cooling operation and the heating operation, for example. Therefore, the development of a heat pump air conditioner that does not forcibly stop the operation of the air conditioner, and furthermore can reliably notify the user about the arrival of the time for an oil change for the gas engine is desirable.

In consideration of the problems described above, it is an object of the present invention to provide a gas heat pump-type air conditioner that can reliably notify the user about the arrival of the time for changing the engine oil of the gas engine that drives the compressor without stopping the operation of the gas engine.

SUMMARY OF THE INVENTION

The present invention uses the following device to resolve the problems described above.

In a first aspect of a gas heat pump-type air conditioner that forms a cooling cycle by circulating refrigerant using a compressor having a gas engine as a power source, the user is notified about the time for changing the engine oil by displaying a warning while continuing to operate the gas engine when the cumulative hours of operation (t) of the gas engine has reached a predetermined time (T2), and at the same time displaying a warning and carrying out a warning restoration operation procedure after carrying out the first stop procedure subsequent to reaching the predetermined time (T2).

According to this type of a gas heat pump-type air conditioner, while the operation of the gas engine continues, at the point in time that the cumulative hours of operation (t) reaches a predetermined time (T2), the user is notified that the time for changing the engine oil has arrived by a warning message, and at the same time, after the initial operation stop subsequent to reaching the predetermined time (T2), by carrying out a warning restoration operation procedure that is different from the normal procedure, the user becomes strongly aware of the time for changing the engine oil.

In a second aspect of the gas heat pump-type air conditioner that forms a cooling cycle by circulating refrigerant with a compressor having a gas engine as a power source, the user is notified about the time for changing the engine oil by forcibly reducing the engine revolutions for the gas engine to the minimum number of revolutions when the cumulative hours of operation (t) of the gas engine has reached a predetermined time (T3).

According to this type of a gas heat pump-type air conditioner, when the cumulative hours of operation has reached a predetermined time (T3), the gas engine is operated after forcibly reducing the number of revolutions to the minimum, and thus a state in which the capacity of the air conditioner is drastically reduced occurs, and the user can be notified about the time for changing the engine oil while continuing the operation of the gas engine. Furthermore, by operating the gas engine forcibly at the minimum number of revolutions, the damage risk to the gas engine due to deterioration of the engine oil can be reduced to a minimum.

In this type of gas heat pump-type air conditioner, after the initial stop procedure subsequent to reaching the predetermined time (T3), preferably a warning is displayed and a warning restoration operation procedure is carried out. Thereby, after the initial operation stop subsequent to reaching the predetermined time (T3), by carrying out a warning restoration operation procedure that differs from a normal procedure, the user can be strongly made aware again that the time for changing the engine oil has arrived.

In a fourth aspect of the gas heat pump-type air conditioner that forms a cooling cycle by circulating refrigerant with a compressor having a gas engine as a power source, when the cumulative hours of operation (t) of the gas engine has reached a predetermined time (T4) and each time the cumulative hours of operation (t) is increased from the predetermined time (T4) by a predetermined time (Δt), the user is notified about the time for changing the engine oil by forcibly reducing the engine revolutions of the gas engine to the minimum number of revolutions, and at the same time after the predetermined time (T4) has been passed, when the stop procedure is carried out, a warning is displayed and at the same time a warning restoration operation procedure is carried out.

According to this type of a gas heat pump-type air conditioner, when the cumulative hours of operation of the gas engine has reached a predetermined time (T4) and each time the cumulative hours of operation (t) has increased by a predetermined time (Δt) from the predetermined time (T4), the gas engine is operated by forcibly reducing the number of revolutions to the minimum number, and thus a state in which the air conditioner capacity is drastically reduced occurs, and the user can be notified a plurality of times that the time for changing the engine oil has arrived while the operation of the gas engine continues. In addition, after carrying out the stop procedure subsequent to reaching the predetermined time (T4), a warning is displayed and at the same time the warning restoration operation procedure is carried out, and thus after the operation stop subsequent to reaching the predetermined time (T4), a warning restoration operation procedure is carried out that is different from the normal procedure, and thus the user can be made strongly aware again over a plurality of times that the time for changing the engine oil has arrived.

In addition, in this type of gas heat pump-type air conditioner, when the cumulative hours of operation (t) becomes a predetermined time that is the predetermined time (Δt) added to the predetermined time (T4), preferably the operation of the gas engine is forcibly stopped, and thereby because the cumulative hours of operation (t) of the gas engine is limited, damage originating in inadequate lubrication can be prevented.

In a sixth aspect of the gas heat pump-type air conditioner that forms a cooling cycle by circulating refrigerant with a compressor having a gas engine as a power source, the gas heat pump-type air conditioner comprises: a first warning stage in which, when the cumulative hours of operation (t) of the gas engine has reached a first predetermined time (T1), the user is notified about the time for changing the engine oil by displaying a warning while continuing to operation the gas engine; a second warning stage in which, when the cumulative hours of operation (t) has reached a second predetermined time (T2), the user is notified about the time for changing the engine oil by displaying a warning while continuing to operation the gas engine when the cumulative hours of operation (t) of the gas engine has reached a second predetermined time (T2) and at the same time, after the first stop procedure is carried out subsequent to having reached the second predetermined time (T2), in addition to displaying a warning the warning restoration operation procedure is carried out; a third warning stage in which, when the cumulative hours of operation (t) has reached a third predetermined time (T3), the user is notified about the time for changing the engine oil by forcibly reducing the engine revolutions of the gas engine to the minimum number of revolutions, and after the first stop procedure carried out subsequent to having reached the third predetermined time (T3), a warning is displayed and at the same time the warning restoration operation procedure is carried out; a fourth warning stage in which, when the cumulative hours of operation (t) of the gas engine has reached a fourth predetermined time (T4) and each time the cumulative hours of operation (t) is increased from the predetermined time (T4) by a predetermined time (Δt), the user is notified about the time for changing the engine oil by forcibly reducing the engine revolutions of the gas engine to the minimum number of revolutions and at the same time after the fourth predetermined time (T4) has been passed when the stop procedure is carried out, a warning is displayed and at the same time a warning restoration operation procedure is carried out; and a fifth warning stage in which, when the cumulative operation value (t) has become a predetermined time (T5), which is a predetermined time (Δt) or greater added to the predetermined time (T4), the operation of the gas engine is forcibly stopped.

According to this type of gas heat pump-type air conditioner, from the time that the cumulative hours of operation (t) of the gas engine has reached a first predetermined time (T1) until reaching the fifth predetermined time (T5), the user can be reliably notified about the arrival of the time for changing the oil by repeating many times the first through fourth warning stages without stopping the gas engine.

In the gas heat pump-type air conditioner according to any of the first, third, fourth, fifth, or sixth aspects, preferably in the operation start procedure up to a predetermined number of times, the warning restoration operation procedure displays a warning while continuing the operation stop state and at the point in time that the operation start procedure is carried out more than the predetermined number of times displays a warning and starts the operation, and thereby the user can be made strongly aware that the time for changing the engine oil has arrived by not allowing the smooth operation start that occurs during normal times and displaying a warning.

DETAILED DESCRIPTION OF THE INVENTION

Figure 1:
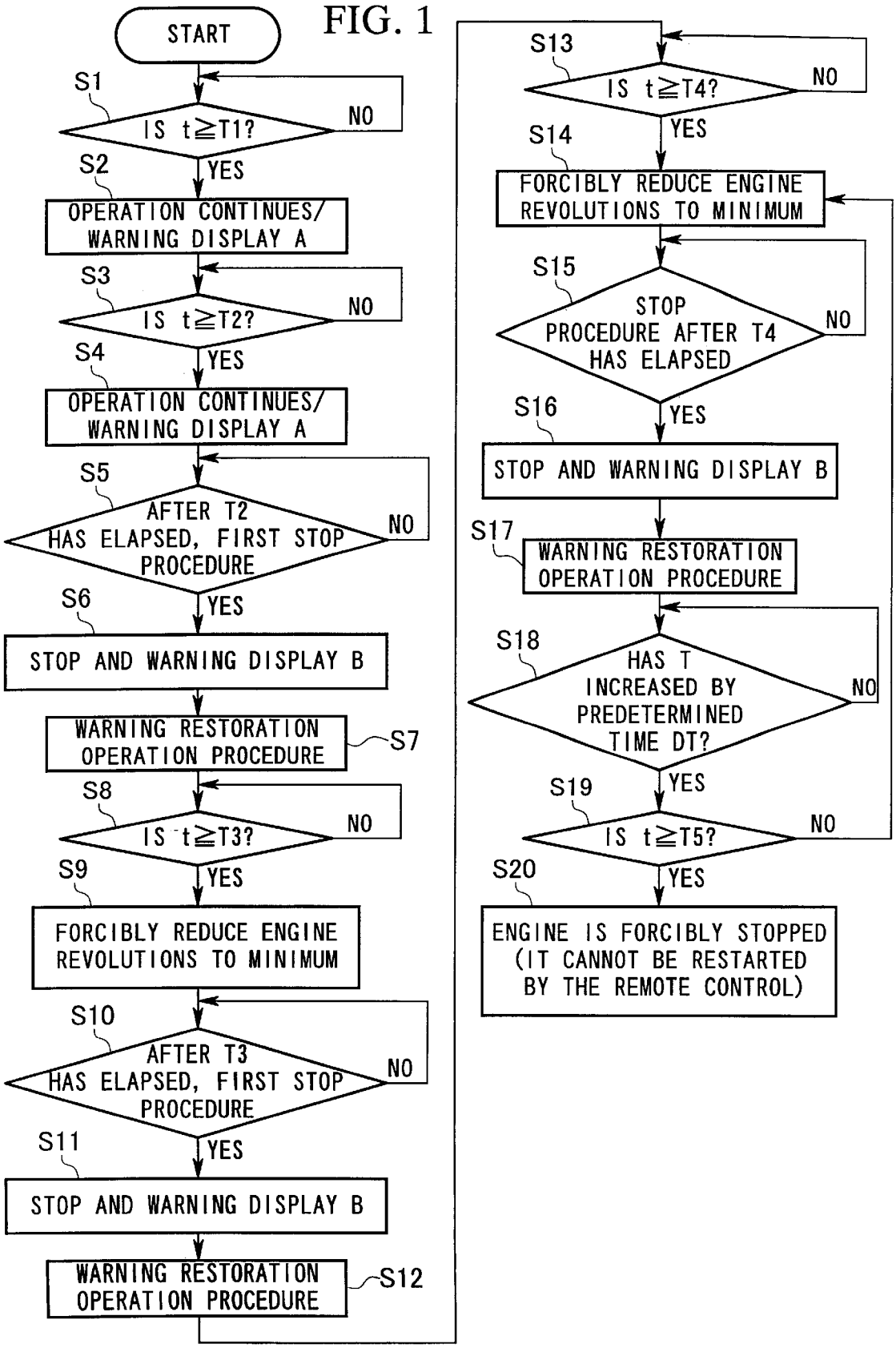
FIG. 1 is a drawing that shows an embodiment of the gas heat pump-type air conditioner according to the present invention, and is a flowchart showing the process up to the determination of the time for the oil change and the issuing of a warning.

Below, an example of the structure of a gas heat pump-type air conditioner according to the present invention will be explained referring to the drawings.

Figure 4:
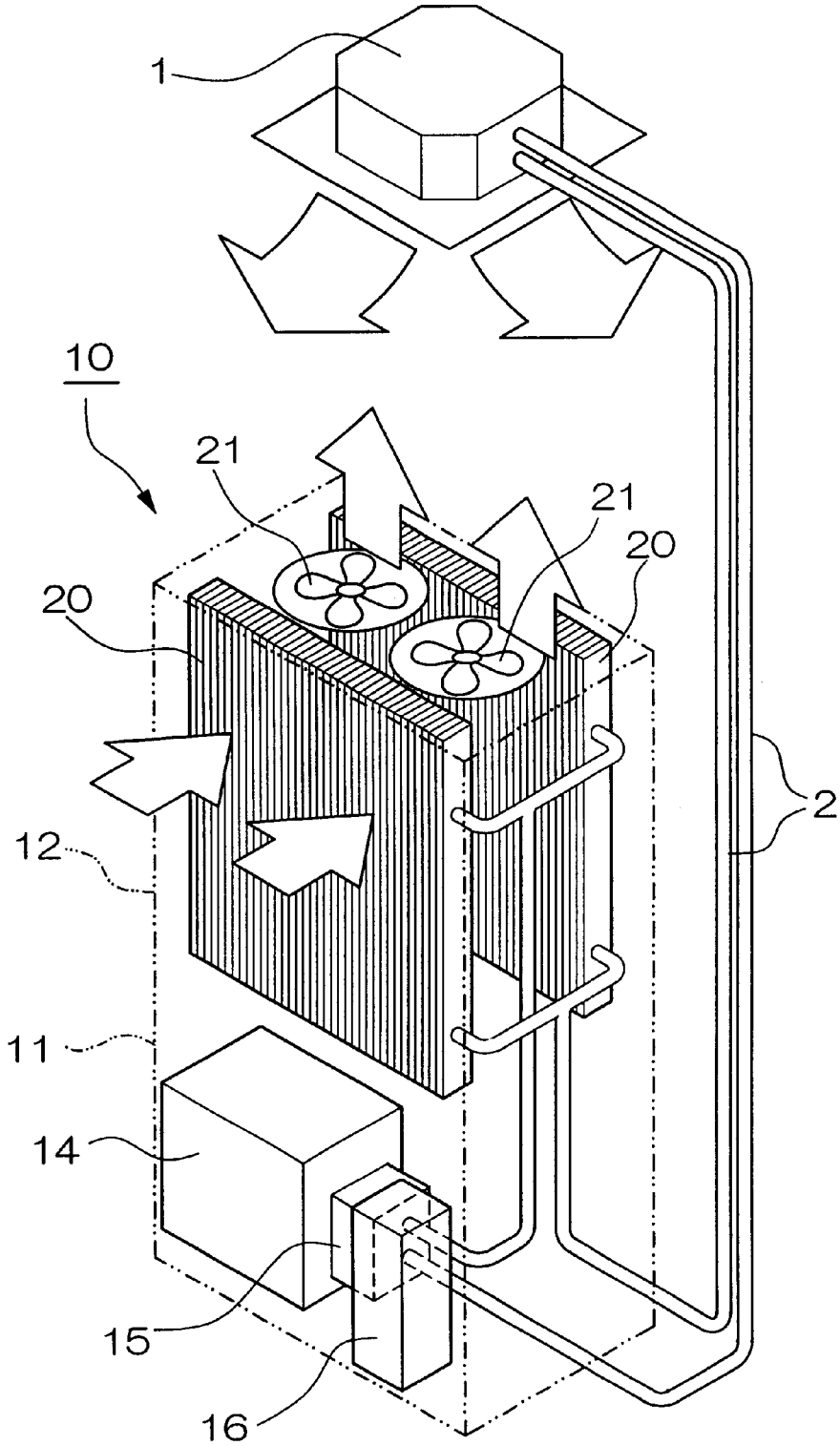
FIG. 4 is a schematic diagram showing an outline of the gas heat pump-type air conditioner.

As shown in FIG. 4, the gas heat pump-type air conditioner (GHP) is broadly structured from an interior unit 1 and an exterior unit 10.

In the interior unit 1, an internal heat exchanger is provided that absorbs the heat from the interior air during the cooling operation by vaporizing a low temperature, low pressure liquid refrigerant, and heats the interior air during the heating operation by condensing and liquefying a high temperature, high pressure gas refrigerant. In this interior heat exchanger, a low temperature, low pressure liquid refrigerant (during the cooling operation) or a high temperature, high pressure gas refrigerant (during the heating operation) is supplied from the interior unit 10 (described below) by refrigerant pipes 2. Moreover, the interior air that is cooled or heated is evacuated by the operation of an interior fan, and blown into the interior after exchanging the heat with the refrigerant by passing through the interior heat exchanger.

The exterior unit 10 comprises a refrigerant circuit that provides a compressor, an exterior heat exchanger, an expansion valve, a four way valve, and the like, and a gas engine part that provides a gas engine that drives the compressor and the various related devices attached thereto.

The lower machine chamber 11 and the upper heat exchange chamber 12 of this exterior unit 10 are partitioned by a partition panel (not illustrated), and the essential devices such as the gas engine 14, the compressor 15, and the controller 16 are disposed in the machine chamber 11, and the essential devices such as the external heat exchanger and the external fan 21 are disposed in the heat exchange chamber 12. Moreover, a ventilation opening is provided in the partition panel so that the machine chamber 11 and the heat exchange chamber 12 communicate with each other.

Figure 3A:
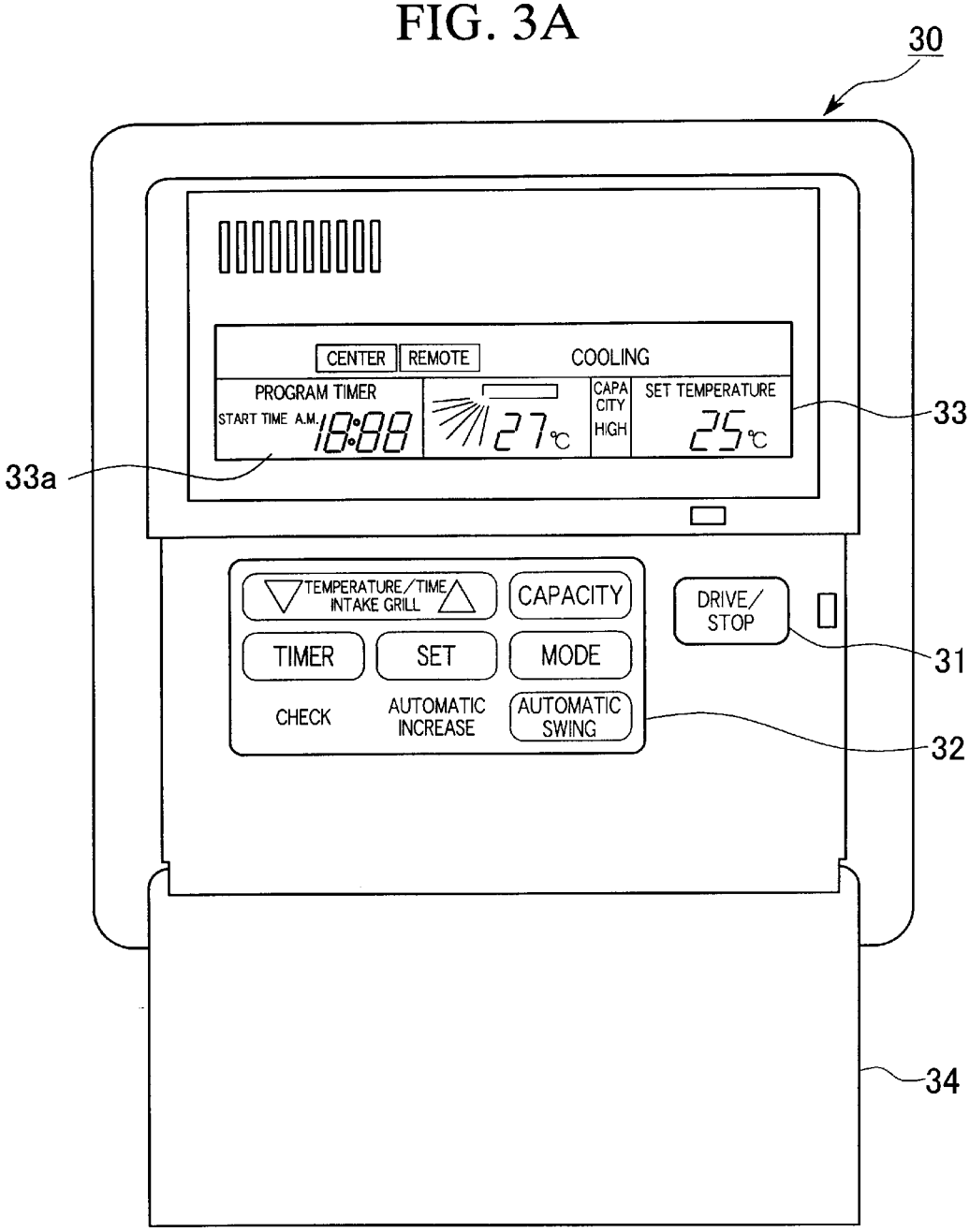
FIG. 3A and FIG. 3B are drawings showing an example of the structure of the remote control used in the gas heat pump-type air conditioner according to the present invention, where 3A is a frontal view and 3B is a drawing showing an example of the warning display using the time display part of the remote control.

In addition, either a permanently placed or a portable remote control 30 as shown in FIG. 3A is disposed at the interior location where the interior unit 1 is provided. This remote control 30 provides a display part that displays each type of operation of the heat pump air conditioner, such as the on/off procedure for the air conditioning operation, the operation mode switch procedure for cooling/heating/dehumidifying, and the like, and switches for carrying out temperature setting, the capacity setting, and the operation state.

Figure 3B:
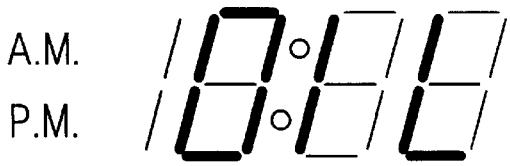

In the remote control 30 shown in FIGS. 3A and 3B, the reference numeral 31 in the figure denotes the on/off switch for carrying out the procedure for starting and stopping, reference numeral 32 denotes the control part where the switches are disposed for selecting and switching settings such as the operation mode, the temperature, and the capacity, and reference numeral 33 denotes the display part that displays, for example, the temperature setting, the capacity, and the time. Additionally, reference numeral 34 in the figure denotes a lid that opens and closes. Normally the lid is closed, the display part 33 is exposed, and the on/off switch 31 and the control part 32 are covered.

In order to drive the compressor 15 by the gas engine 14, the gas heat pump-type air conditioner having the structure described above requires a lubricating oil change for the gas engine 14 depending on the cumulative hours of operation t. This is in order to prevent the occurrence of engine problems such as loss of the original functions due to deterioration of the lubrication oil, scorching, or the like.

Thus, in order to reliably notify the user about the time for changing the engine oil in the gas heat pump-type air conditioner of the present invention, warnings are displayed at stages according to the flowchart shown in FIG. 1. This type of control is incorporated, for example, into the controller 16 of the exterior unit 10.

In the flowchart shown in FIG. 1, the cumulative hours of operation t is measured from the start of the first operation. Because the cumulative hours of operation t can be measured starting at the point in time that an oil change has been completed, a reset switch (not illustrated) is provided in the controller 16.

Thus, when the operation of the gas engine 14 is started, even if the operation is stopped for a while, the cumulative hours of operation t can be measured by adding the operating hours in sequence. Additionally, the cumulative hours of operation t are compared to a predetermined time (set time) T1 in step 1 (S1). Here, in the case that the gas engine 14 requires an oil change (maintenance) at about 10,000 hours, the first predetermined time T1 preferably will be set beforehand to about 9800 hours, which is somewhat lower.

When the cumulative hours of operation t reaches the predetermined time T1, at step 2 (S2), warning display A is displayed while the operation of the gas engine 14 continues.

Here, to explain a concrete example of the warning display A, using the time display part 33*a* of the remote control 30, the time display alternates with the display of the letters "OIL", blinking at about one second intervals. This first warning stage can be characterized as a notification that the time for changing the engine oil is nearing, and more preferably at this stage the user will implement maintenance that includes the oil change by contacting a service person or the like. Moreover, even if the gas engine is stopped, that is, while the air conditioning operation is stopped, the above-mentioned "OIL" display blinks on the remote control 30. Moreover, after the warning display A of step 2, when the oil change has been carried out and the reset switch has been reset, the cumulative hours of operation t is reset to 0, and the processing returns to the start of the flowchart.

In the case that the oil change is not carried out during the first warning stage described above and the reset switch has not been reset, the cumulative hours of operation t is added to a predetermined time T. Thus, at step 3 (S3), the cumulative hours of operation t and a second predetermined time (set time) T2 are compared. This predetermined time T2 is set, for example, at about 10,000 hours. When the cumulative hours of operation t reach the predetermined time T2, the second warning stage starts, and at step 4 (S4), the warning display A is displayed while the operation of the gas engine 14 continues.

Moreover, the warning display at this time is identical to the warning display A in step 2 as described above, but of course this can be distinguished by using a different warning display.

In the case that the oil is not changed in spite of the issuing of a warning display in step 4, in step 5, when the initial (first) stop procedure (S5) is carried out after passage of the predetermined time T2, at step 6, the operation is stopped, and at the same time, warning display B is displayed, and at step 7 the warning restoration operation procedure (S7) is implemented. Moreover, after the stop operation in step 5, when the reset switch is reset due to carrying out the oil change, the cumulative hours of operation t is reset to 0, and the processing returns to the start of the flowchart.

Here, to explain a concrete example of the warning display B, a time display part 33*a* of the remote controller 30 is used, similar to that of the warning display A described above, and the warning is displayed by continuously lighting the display of the letters "OIL". This second warning stage has the object of notifying the user that the time for changing the engine oil has arrived, and that a quick response is necessary. Thereby, not only is the warning display B displayed, but also a warning restoration operation procedure that is different from the normal operation start is implemented when the next operation starts.

Figure 2:
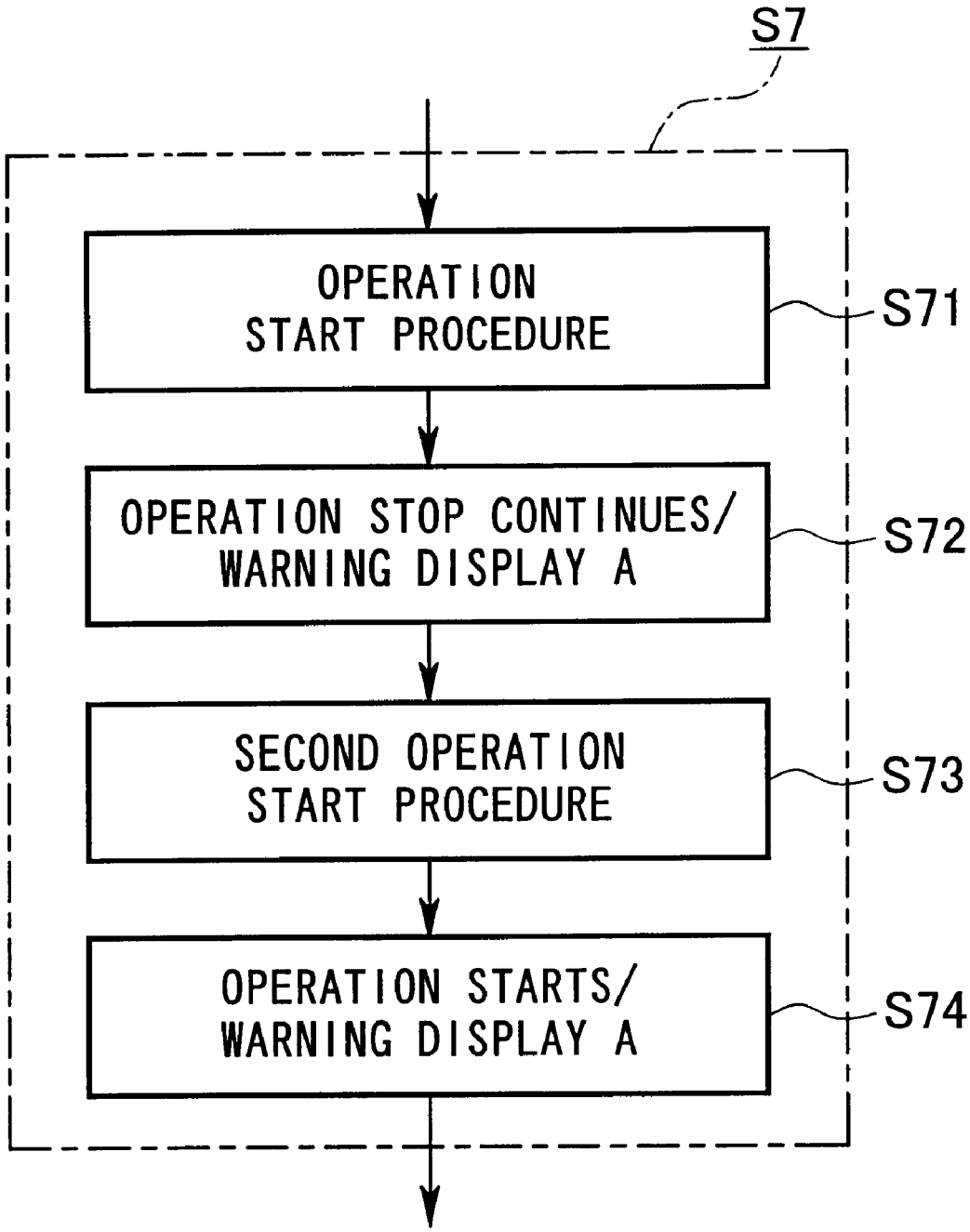
FIG. 2 is a drawing that shows a flowchart illustrating a detailed example of the warning operation procedure in FIG. 1.

As shown in FIG. 2, in this procedure for the warning restoration operation S7, even if an operation start procedure (S71) is carried out by operating the on/off switch 31, the state of the stopped operation continues (that is, the operation is not actuated), and at the same time when the warning display A is displayed (S72), the change of the oil is prompted by the blinking display of "OIL". At the same time, the user is made strongly aware of the necessity for changing the oil by making the starting of the air conditioning operation impossible. In addition, when an oil change is carried out after this state and the reset switch is reset, subsequently the cumulative hours of operation t is reset to 0 and the processing returns to the start of the flowchart.

However, when the second operation start procedure (S73) is carried out without the oil having been changed, the normal air conditioning operation is started and the warning display A is displayed (S74). Therefore, for example, a service person is called after becoming aware of the necessity for the oil change, and until the implementation of the maintenance such as the oil change, the air conditioning operation can be continued for a limited short time interval (for example, about 50 hours) up to the third warning stage described below.

Moreover, in the warning restoration operation procedure S7 described above, at the second operation start procedure (S73), the normal air conditioning operation starts, but when, for example, the third or higher operation start procedure is attempted to start the air conditioning operation, the user can be made more strongly aware of the necessity for a change of the oil, and an oil warning such as a sound may occur when attempting to start the air conditioning operation to distinguish this from a normal operation start.

In the above-described second warning stage as well, when the operation of the gas engine 14 is continued without changing the oil, the third warning stage described above is entered, and in step 8 the cumulative hours of operation t is compared to a third predetermined time (set time interval) T3 (S8). This predetermined time T3 is set so that the difference between it and the above-described predetermined time T2 is not very large, for example, about 10050 hours.

In addition, when the cumulative hours of operation t has reached the predetermined time T3, in step 9 the number of revolutions of the gas engine 14 is forcibly reduced to minimum level (S9). As a result, because the compressor 15 cannot supply the desired amount of refrigerant, the capacity for heat exchange becomes insufficient, and the air conditioning capacity drastically declines. As a result, the user becomes physically aware of the abnormality in the air conditioner, and is prompted to respond.

Moreover, although omitted from the flowchart in the figure, in the case that after the passage of T2, the predetermined time T3 passes without carrying out the stop operation (S5) for the first time, the processing moves to the operation of step 9 described above.

In the next step 10, when the initial operation stop procedure, that is to say, the first operation stop procedure after the passage of the predetermined time T3, is carried out subsequent to entering in this operational state, in step 11 the operation is stopped, and at the same time the warning display B is displayed (S11). In addition, when the air conditioning operation begins, in step 12, the warning restoration operation procedure S12 is implemented. This warning restoration operation procedure S12 is substantially the same as the warning restoration operation procedure S7 described above. Specifically, as shown in FIG. 2, even if the operation start procedure (S71) is carried out by operating the on/off switch 31, the state of operation stop is continued, and at the same time the warning display A is displayed (S71), the oil change is prompted by the blinking display of "OIL", and simultaneously the user is made strongly aware of the necessity of the oil change because the air conditioning operation can no longer by started. In addition, if the oil change is carried out from this state and the reset switch is reset, the subsequent cumulative hours of operation t is reset to 0, and the processing returns to the start of the flowchart.

However, when the second operation start procedure (S73) is carried out without an oil change having been carried out, the warning display A is displayed after the air conditioning operation starts normally (S74). Therefore, for example, until a service person is called after becoming aware of the necessity of an oil change and the maintenance such as an oil change is carried out, the air conditioning operation can continue for a limited short time (for example, about 50 hours) until the fourth warning stage described below.

Even at the third warning stage described above, when the operation of the gas engine 14 continues without an oil change having been carried out, the subsequent fourth warning stage is entered, and in step 13, the cumulative hours of operation t is compared with a fourth predetermined time (set time interval) T4 (S13). Here, the predetermined time T4 that is used is set so that the difference between it and the predetermined time T3 described above is not very large, for example, to about 10100 hours.

In addition, when the cumulative hours of operation t reaches the predetermined time T4, at step 14, the number of revolutions of the gas engine 14 is forcibly reduced to minimum level (S14). As a result, because the compressor 15 cannot supply the desired amount of refrigerant, the capacity for heat exchange becomes insufficient, and the air conditioning capacity drastically declines. As a result, the user becomes physically aware of the abnormality in the air conditioner, and is prompted to respond.

Moreover, although omitted from the flowchart in the figure, in the case that after the passage of T3, the set time T4 passes without carrying out the stop operation (S10) for the first time, the processing moves to the operation of step 14 described above.

In the next step 15, when the initial operation stop procedure, that is to say, the first operation stop procedure after the passage of the predetermined time T4, is carried out subsequent to entering this operational state, in step 15 the operation is stopped, and at the same time the warning display B is displayed (S15). In addition, when the air conditioning operation starts, in step 17, the warning restoration operation procedure S17 is implemented. This warning restoration operation procedure S17 is substantially the same as the warning restoration operation procedures S7 and S11 described above, and thus the detailed explanation thereof is omitted here.

Thus, after the air conditioning operation is started due to the warning restoration operation procedure S17, from step 18 it is determined whether or not the cumulative hours of operation t has increased a predetermined time interval Δt. In addition, at the point in time that the cumulative hours of operation t has increased by at least Δt, that is, when the cumulative hours of operation t has reached t+Δt, in the next step S19, it is determined whether or not the cumulative hours of operation t has reached the fifth predetermined time (set time) T5. As a result, if the cumulative hours of operation t is equal to or less than the predetermined time T5, the processing returns to step 14, the number of revolutions of the gas engine 14 is forcibly reduced to minimum level, and the user is prompted to carry out an oil change due to becoming physically aware of the abnormality in the air conditioner.

Here, the predetermined time Δt mentioned above is set to an extremely short time interval, for example, about four hours, and in addition, in order to protect the gas engine 14, finally the predetermined time T5 that forcibly stops the engine is set, for example, to about 10300 hours.

Therefore, when the operation continues without carrying out an oil change even after the cumulative hours of operation t has exceeded the predetermined time T4, the frequency of the forcible reduction of the air conditioning capacity occurs at the short interval of every four hours, and thus, the user can be notified much more strongly and frequently about the necessity of carrying out an oil change.

In addition, when the operation continues up to the predetermined time T5 without an oil change having been carried out in spite of repeated warnings, finally, in order to protect the gas engine 14, in step S20, a forcible engine stop is implemented (S20), and the operation cannot be restarted using the remote control 30.

Moreover, although omitted from the flowchart in the figures, in the case that the setting time T5 passes without the stop operation being carried out after the passage of T4 (S15), the processing moves to the procedure of step 20.

In this manner, in the gas heat pump-type air conditioner of the present invention, the user can be reliably notified about the necessity of carrying out an oil change in stages from a first through fourth warning stage, and furthermore, by using warning displays, warning restoration operation procedures with normal operation procedures cannot be carried out, reducing the air conditioning capacity so that it is physically sensed, or a combination thereof, there is no need to forcibly stop the gas engine (the air conditioning operation). Thus, the decrease in the feeling of the air conditioning produced by forcibly stopping the air conditioning operation can be reduced to a minimum, and the user can be prompted to a quick response (carrying out the oil change).

In the embodiment described above, as a warning displays A and B, that is, the blinking display or continuous display of the characters "OIL", was used, but the warning displays of the present invention are not limited thereby, and various modifications are possible, such as (1) providing a dedicated display lamp, (2) producing a warning by a sound, or (3) using a lamp display and sound together.

In addition, for the warning restoration operation procedure as well, any method is satisfactory in which the user is made aware of the fact that normal operation start procedures are not being carried out and is thus aware of the abnormality in the air conditioner, and thus, various other embodiments of the present invention are possible in which the operation cannot be started if the operation start procedure is the second time or thereafter.

Moreover, each of the predetermined times given as examples in the embodiment described above are simply concrete examples given for ease of understanding, and the actual time settings are values that are appropriately modified depending on conditions such as the gas engine 14 and the type of engine oil that is used.

In addition, the structure of the present invention is not limited by any of the embodiments, and they can be appropriately modified within a range that does not depart from the spirit of the invention.

According to the gas heat pump-type air conditioner of the present invention, the user can be notified about the necessity of carrying out an oil change determined in first through fourth warning stages by comparing the cumulative hours of operation t of the gas engine to predetermined times. Furthermore, until reaching the cumulative hours of operation corresponding to the final fifth warning stage, there is no necessity to forcibly stop the gas engine (the air conditioning operation), and by using a display warning, a warning restoration operation procedure in which normal operation procedures become impossible, a reduction in the air conditioning capacity that can be physically sensed by the user, or a combination thereof, the user can be reliably notified about the arrival of the time for carrying out an oil change.

Thereby, because the reductions in the air conditioned feeling produced by forcibly stopping the air conditioning operation can be reduced to a minimum, and the user can be prompted to make a quick response (carrying out the oil change), compared to the conventional technology in which forcibly stopping the operation of the air conditioning operation is unavoidable, there is the significant effect in providing a superior air conditioned feeling and in improving the saleability of the product.

What is claimed is:

1. A gas heat pump-type air conditioner that forms a cooling cycle by circulating refrigerant using a compressor having a gas engine as a power source, wherein:

a user is notified about the time for changing the engine oil by displaying a warning while continuing to operate said gas engine when the cumulative hours of operation (t) of said gas engine has reached a predetermined time (T2), and at the same time issuing a warning display and carrying out a warning restoration operation procedure after carrying out the first stop procedure subsequent to reaching said predetermined time (T2).

2. A gas heat pump-type air conditioner that forms a cooling cycle by circulating refrigerant using a compressor having a gas engine as a power source, wherein:

the user is notified about the time for changing the engine oil by forcibly reducing the engine revolutions of the gas engine to the minimum number of revolutions when the cumulative hours of operation (t) of said gas engine has reached a predetermined time (T3).

3. A gas heat pump-type air conditioner according to claim 2, wherein after carrying out the first stop procedure subsequent to having reached said predetermined time (T3), a warning is displayed and at the same time a warning restoration operation procedure is carried out.

4. A gas heat pump-type air conditioner that forms a cooling cycle by circulating refrigerant using a compressor having a gas engine as a power source, wherein:

when the cumulative hours of operation (t) of said gas engine has reached a predetermined time (T4) and each time said cumulative hours of operation (t) is increased from the predetermined time (T4) by a predetermined time (Δt), the user is notified that the time for changing the engine oil has arrived by forcibly reducing the engine revolutions of said gas engine to the minimum number of revolutions and at the same time, after said predetermined time (T4) has been passed, when the stop procedure is carried out, a warning is displayed and at the same time a warning restoration operation procedure is carried out.

5. A gas heat pump-type air conditioner according to claim 4 wherein when said cumulative hours operation (t) reaches a predetermined time (T5), which is said predetermined time (Δt) or greater added to said predetermined time (T4), the operation of said gas engine is forcibly stopped.

6. A gas heat pump-type air conditioner that forms a cooling cycle by circulating refrigerant using a compressor having a gas engine as a power source, comprising:

a first warning stage in which, when the cumulative hours of operation (t) of said gas engine has reached a first predetermined time (T1), the user is notified about the time for changing the engine oil by displaying a warning while continuing to operation said gas engine;

a second warning stage in which, when said cumulative hours of operation (t) has reached a second predetermined time (T2), the user is notified about the time for changing the engine oil by displaying a warning while continuing to operate said gas engine when the cumulative hours of operation (t) of said gas engine has reached a second predetermined time (T2) and at the same time after the first stop procedure is carried out subsequent to having reached said second predetermined time (T2), in addition to displaying a warning the warning restoration operation procedure is carried out;

a third warning stage in which, when said cumulative hours of operation (t) has reached a third predetermined time (T3), the user is notified about the time for changing the engine oil by forcibly reducing the engine revolutions of said gas engine to the minimum number of revolutions, and after the first stop procedure carried out subsequent to having reached said third predetermined time (T3), a warning is displayed and at the same time the warning restoration operation procedure is carried out;

a fourth warning stage in which, when the cumulative hours of operation (t) of said gas engine has reached a fourth predetermined time (T4) and each time said cumulative hours of operation (t) is increased from the predetermined time (T4) by a predetermined time (Δt), the user is notified about time for changing the engine oil by forcibly reducing the engine revolutions of said gas engine to the minimum number of revolutions and at the same time after said fourth predetermined time (T4) has been passed, when the stop procedure is carried out, a warning is displayed and at the same time a warning restoration operation procedure is carried out; and a fifth warning stage in which, when said cumulative operation value (t) has increased from said fourth predetermined time (T4) to said fifth predetermined time (T5), the operation of said gas engine is forcibly stopped.

7. A gas heat pump-type air conditioner according to any of claims 1, 3, 4, 5, and 6 wherein, in the operation start procedure up to a predetermined number of time, said warning restoration operation procedure displays a warning while continuing the operation stop state, and displays a warning and starts the operation at the point in time that the operation start procedure is carried out more than said predetermined number of times.

* * * * *